US005795244A

United States Patent [19]

Lu

[11] Patent Number: 5,795,244

[45] Date of Patent: Aug. 18, 1998

[54] GOLF CLUB SHAFT WITH AN AIRFOIL CHANNEL

[76] Inventor: Clife S. Lu, 282 Newbridge Rd., Hicksville, N.Y. 11801

[21] Appl. No.: 802,984

[22] Filed: Feb. 21, 1997

[51] Int. Cl.[6] ..... A63B 53/10; A63B 53/12

[52] U.S. Cl. ..... 473/317; 473/318

[58] Field of Search ..... 473/316–323

[56] References Cited

U.S. PATENT DOCUMENTS

| | | | |
|---|---|---|---|
| 1,125,029 | 1/1915 | Lard | 473/316 |
| 1,396,470 | 11/1921 | Taylor . | |
| 1,450,091 | 3/1923 | Lard . | |
| 1,965,857 | 7/1934 | Petry . | |
| 1,996,298 | 4/1935 | Lard . | |
| 2,018,723 | 10/1935 | Hutchison . | |
| 2,027,635 | 1/1936 | Cuningham . | |
| 2,126,717 | 8/1938 | Barnhart . | |
| 2,150,737 | 3/1939 | Chittick . | |
| 3,125,038 | 3/1964 | Amato . | |
| 5,251,896 | 10/1993 | Gerlach . | |
| 5,335,908 | 8/1994 | Bamber . | |

*Primary Examiner*—Sebastiano Passaniti
*Assistant Examiner*—Stephen L. Blau
*Attorney, Agent, or Firm*—Aquilino & Welsh

[57] ABSTRACT

A golf club shaft is disclosed. The golf club shaft includes an elongated tubular member having an outer surface and a longitudinal axis. The elongated tubular member has a plurality of channels formed about the outer surface of the elongated tubular member and extending substantially parallel to the longitudinal axis. The plurality of channels are shaped and dimensioned to create air flow about the elongated tubular member, reducing air resistance as the golf club shaft is swung by an individual.

21 Claims, 3 Drawing Sheets

GOLF CLUB SHAFT WITH AN AIRFOIL CHANNEL

BACKGROUND OF THE INVENTION

1. Field of the Invention

The invention relates to a golf club shaft. More particularly, the invention relates to a golf club shaft having a concave channel which improves the aerodynamic and strength characteristics of the golf club shaft.

2. Description of the Prior Art

Conventional golf club shafts generally include a tubular member with a smooth outer surface. The smooth outer surface, while providing an aesthetically pleasing appearance, creates air flow about the golf club shaft resulting in greater drag generated by air resistance as the club is swung by a golfer (see FIG. 8).

Attempts have been made to provide more aerodynamically desirable golf club shafts. However, these shafts are generally very unconventional in shape and feel. For example, U.S. Pat. No. 5,335,908 to Bamber discloses an aerodynamic golf club shaft. The aerodynamic characteristics of the golf club are improved by providing a shaft with a noncircular cross-section. While the noncircular golf shaft reduces air resistance as the golf club is swung, the noncircular shaft design is difficult to manufacture. In addition, the noncircular design of the shaft presumably provides a different feel that may be undesirable to many golfers.

In addition, the strength characteristics, and in particular, the bending point, of a golf club shaft are often difficult to vary to a suit golfers of differing skill levels. The term "bending point" is used throughout this specification to designate the point along the golf club shaft where the most bending occurs when the golf club shaft is longitudinally compressed the bending point, along with other strength and stiffness characteristics of a golf club shaft, define the swing characteristics of a golf club shaft. It should also be understood that other terms used within act to describe the bending point of a golf club shaft include, but are not limited to, flex point, pattern, curve, and kick point. The bending point of golf club shafts is currently controlled by varying the thickness of the golf club shaft at various points along the club shaft. Controlling the bending point in this manner requires substantial tooling, and is consequently, difficult to implement.

As a result, a need still exists for a more aerodynamically sound golf club shaft. In addition, a need exists for a golf club shaft having a bending point which may readily be controlled during the manufacture of the golf club shaft, without sacrificing the impact strength of the golf club shaft. The shaft must be easily manufactured, while still providing a golfer with the feel to which he or she is accustomed when using a golf club shaft having a circular cross-section. The present invention provides such a golf club shaft.

SUMMARY OF THE INVENTION

It is, therefore, an object of the present invention to provide a golf club shaft including an elongated tubular member having an outer surface and a longitudinal axis. The elongated tubular member has a plurality of channels formed about the outer surface of the elongated tubular member and extending substantially parallel to the longitudinal axis. The plurality of channels are shaped and dimensioned to create air flow about the elongated tubular member, reducing air resistance as the golf club shaft is swung by an individual.

It is also an object of the present invention to provide a golf club shaft wherein the elongated tubular member includes a proximal end and a distal end, and the plurality of channels are deeper adjacent the distal end of the elongated tubular member to selectively control the bending point of the golf club shaft and reduce air resistance to a greater degree adjacent the distal end of the elongated tubular member.

It is another object of the present invention to provide a golf club shaft wherein each of the plurality of channels is approximately a maximum of 0.090 inches deep adjacent the distal end of the elongated tubular member and each of the plurality of channels is approximately a maximum of 0.010 inches deep adjacent the proximal end of the elongated tubular member.

It is a further object of the present invention to provide a golf club shaft wherein each of the plurality of channels is approximately 0.079 inches deep adjacent the distal end of the elongated tubular member and each of the plurality of channels is approximately 0.004 inches deep adjacent the proximal end of the elongated tubular member.

It is also an object of the present invention to provide a golf club shaft wherein the elongated tubular member includes a proximal end and a distal end, and the plurality of channels have a greater angle of attack adjacent the distal end of the elongated tubular member to selectively control the bending point of the golf club shaft and reduce air resistance to a greater degree adjacent the distal end of the elongated tubular member.

It is another object of the present invention to provide a golf club shaft wherein each of the plurality of channels is approximately a minimum of 0.050 inches wide adjacent the distal end of the elongated tubular member and each of the plurality of channels is approximately a minimum of 0.10 inches wide.

It is a further object of the present invention to provide a golf club shaft wherein each of the plurality of channels includes a plurality of dimples formed therein.

It is also an object of the present invention to provide a golf club shaft wherein the dimples are grooves extending substantially parallel to the longitudinal axis of the elongated tubular member.

It is another object of the present invention to provide a golf club shaft wherein the dimples are scales formed within each of the plurality of channels.

It is a further object of the present invention to provide a golf club shaft wherein each of the plurality of channels has an outer concave surface, and a first convex airfoil and a second convex airfoil are symmetrically formed within each of the plurality of channels.

It is also an object of the present invention to provide a golf club shaft including nine channels.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
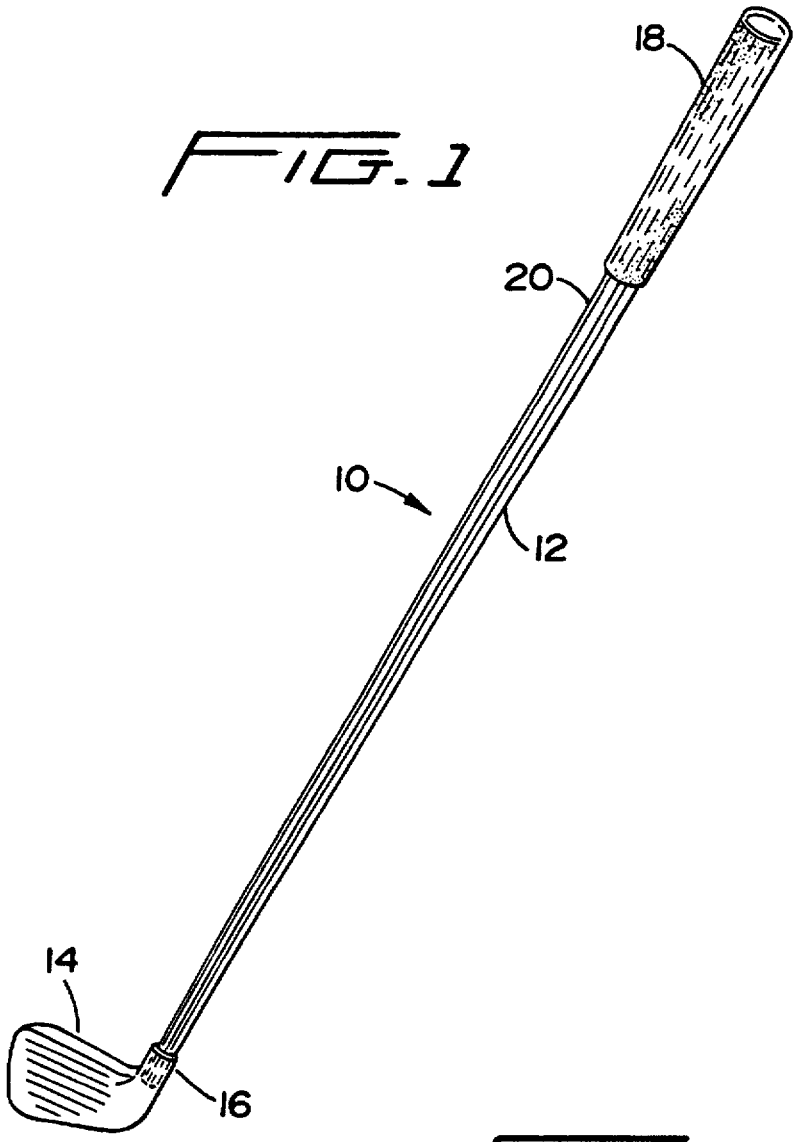
FIG. 1 is a perspective view of the present golf club shaft fully assembled with a grip and club head.
Figure 2:
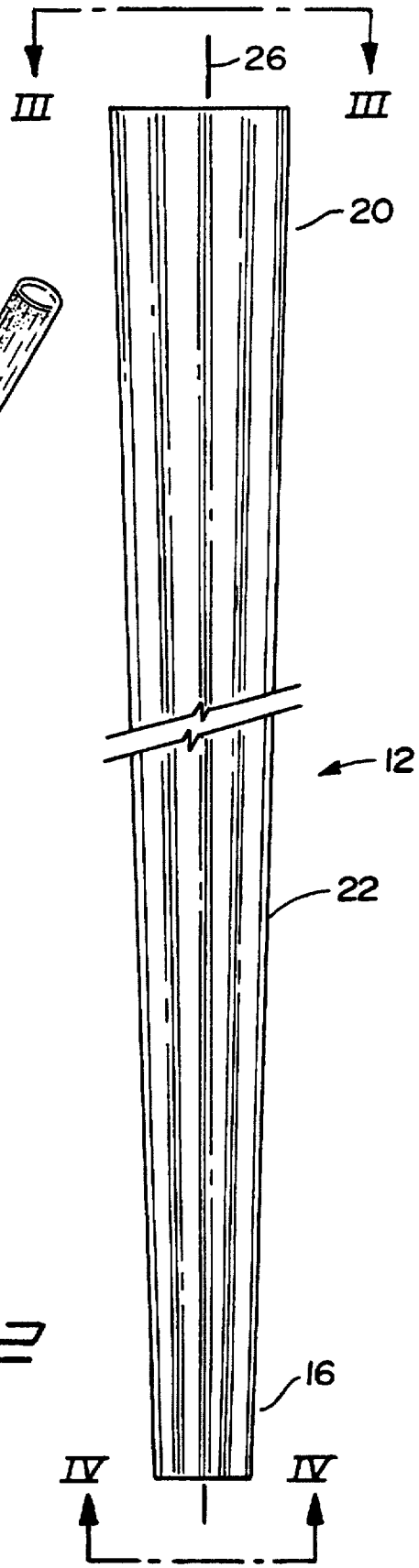
FIG. 2 is a side view of the present golf club shaft.

With reference to FIG. 1, a conventional golf club 10 incorporating the golf club shaft 12 of the present invention is disclosed. The golf club 10 includes a club head 14 secured to the distal end 16 of the golf club shaft 12 and a golf grip 18 secured at the proximal end 20 of the golf club shaft 12. As with conventional golf club shafts, the present golf club shaft 12 tapers as it extends from the proximal end 20 toward the distal end 16. The shaft 12 may be manufactured from a variety of materials commonly used in the manufacture of golf club shafts, including, but not limited to, steel and composite materials. While these materials are disclosed in the present specification, it should be understood that the shaft may be manufactured from a wide variety of materials without departing from the spirit of the present invention.

Figure 3:
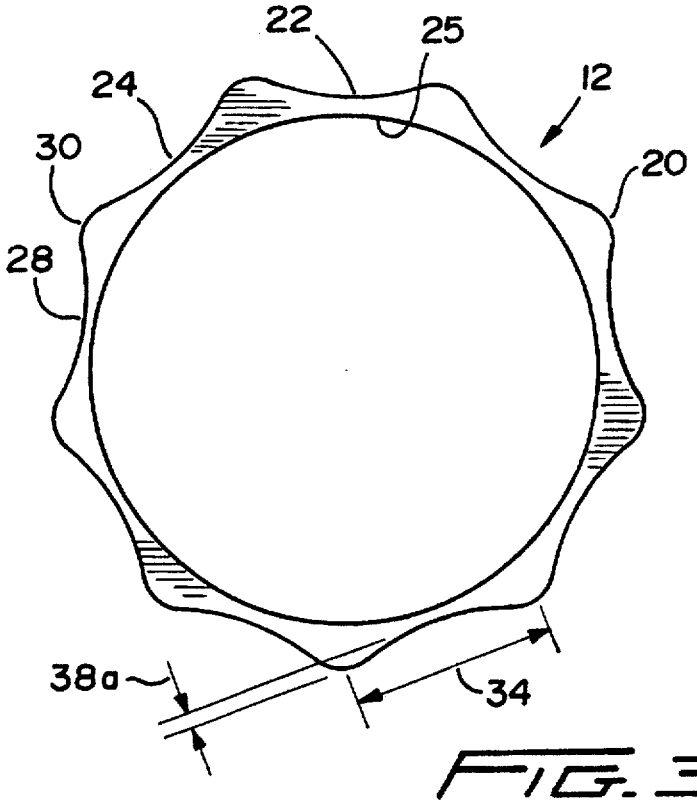
FIG. 3 is a top view of golf club shaft along the line III—III showing the proximal end of the golf club shaft.
Figure 4:
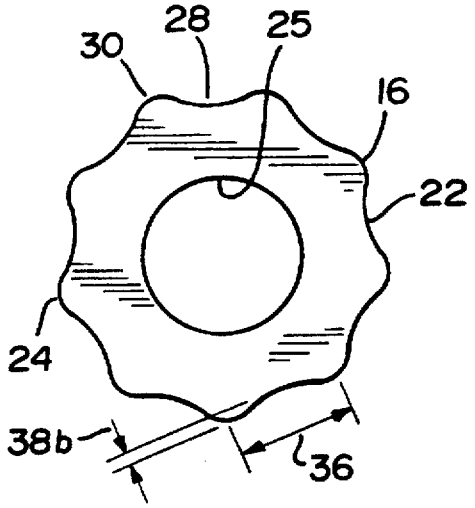
FIG. 4 is a bottom view of the golf club shaft along the line IV—IV showing the distal end of the golf club shaft.

With reference to FIGS. 2, 3, 4, 6 and 7, the present golf club shaft 12 is shown in greater detail. The golf club shaft 12 is formed from an elongated tubular member 22 having an outer surface 24 an inner surface 25 and a longitudinal axis 26. The inner surface 25 has a substantially circular cross section as shown in FIGS. 3, 4, and 4. A plurality of channels 28 are formed in the outer surface 24 of the tubular member 22. The channels 28 extend substantially parallel to the longitudinal axis 26 of the tubular member 22 (discounting the slight taper commonly found in golf club shafts) and are symmetrically positioned about the circumference of the tubular member 22. The channels 28 are shaped and dimensioned to create air flow about the golf club shaft which minimizes the air resistance as the golf club 10 is swung by a golfer. In addition, the ridge 30 formed between adjacent channels 28 acts as an I-beam to reinforce the load on the golf club shaft 12. In this way, the channels 28 provide the golf club shaft 12 with the same strength as traditional golf clubs, while reducing the material used to manufacture the golf club shaft 12. The channels 28 also permit the bending point of the golf club shaft to be pinpointed by varying the shape of the channel 28 as discussed in greater detail below.

Figure 5:
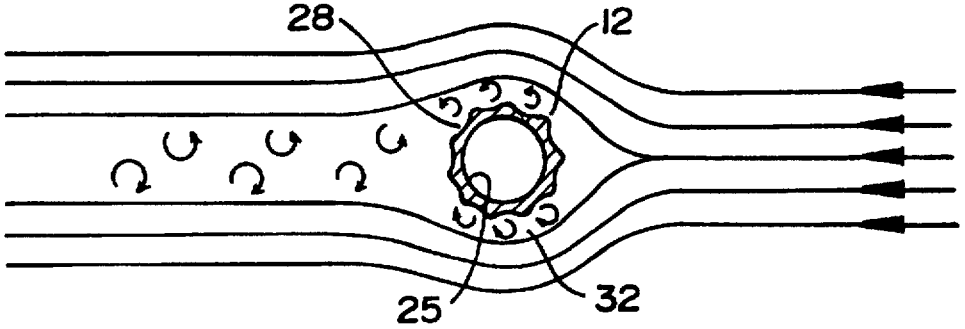
FIG. 5 is a schematic showing air flow about the present golf club shaft.
Figure 8:
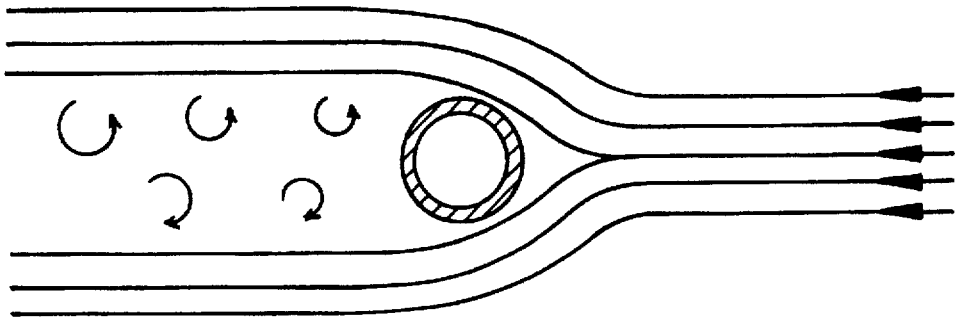
FIG. 8 PRIOR ART
FIG. 8 is a schematic showing air flow about a conventional golf club shaft.

The channels 28 on the tubular member function in much the same way the dimples on a golf ball function. With reference to FIG. 5, the channels 28 modify the air flow about the golf club shaft 12 to minimize the air resistance generated while the golf club is swung. Specifically, the channels 28 create a turbulent boundary layer 32 about the golf club shaft 12. The boundary layer 32 minimizes the drag resulting from air resistance.

In accordance with the preferred embodiment, nine channels 28 are formed in the tubular shaft, although the number of channels may be varied without departing from the spirit of the present invention. As such, and in consideration of the conventional taper found in golf club shafts, each of the channels 28 has a minimum width 34 of approximately 0.10 inches adjacent the proximal end 20 of the tubular member 22 and a minimum width 36 of approximately 0.050 inches adjacent the distal end 16 of the tubular member 22. In accordance with a preferred embodiment of the present invention, each of the channels 28 has a width 34 of approximately 0.157 inches adjacent the proximal end 20 of the tubular member 22 and a width 36 of approximately 0.079 inches adjacent the distal end 16 of the tubular member 22.

In addition, the depth 38*a*, 38*b* of the channels 28 increases as they extend from the proximal end 20 of the tubular member 22 to the distal end 16 of the tubular member 22. The channels 28 are approximately a maximum of 0.010 inches deep adjacent the proximal end 20 of the tubular member 22, while the channels 28 are approximately a maximum of 0.090 inches deep adjacent the distal end 16 of the tubular member 22. Specifically, and in accordance with a preferred embodiment of the present invention, the channels 28 are approximately 0.004 inches deep adjacent the proximal end 20 of the tubular member 22, while the channels 28 are approximately 0.079 inches deep adjacent the distal end 16 of the tubular member 22.

The provision of narrower and deeper channels 28 adjacent the distal end 16 of the tubular member 22 creates a greater angle of attack adjacent the distal end 16 of the tubular member 22 than the wider and shallower channels 28 adjacent the proximal end 20 of the tubular member 22. When the present golf shaft 12 is swung by a golfer, the greater angle of attack adjacent the distal end 16 of the tubular member 22 creates air flow adjacent the distal end 16 of the tubular member 22 exhibiting less air resistance than found at the proximal end 20 of the tubular member 22.

In addition, when the present golf shaft 12 is swung by a golfer, the greater angle of attack adjacent the distal end 16 of the tubular member 22 creates a more controllable bending point. The more controllable bending point at the distal end 16 of the tubular member 22 contrasts with the bending characteristics at the proximal end 20 having a shallower angle of attack. As such, the bending point, and other swing characteristics, of the golf club shaft 12 may be varied by altering the shape of the plurality of channels to suit golfers having different swings.

It should be understood that the dimensions presented above are merely exemplary of the preferred embodiment of the present invention, and the dimensions of the channels could be varied without departing from the spirit of the present invention.

Figure 6:
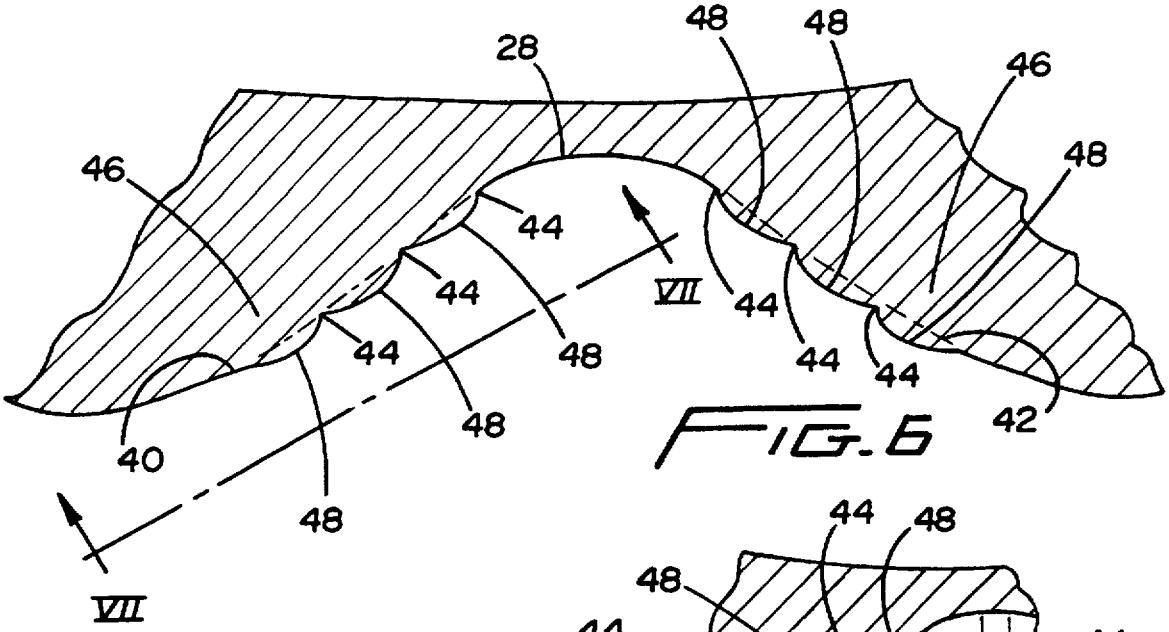
FIG. 6 is a partial cross-sectional view showing a channel in detail.

With reference to FIG. 6, the reduction in air resistance generated by the provision of channels 28 about the circumference of the tubular member 22 is further enhanced by a first convex airfoil 40 and a second convex airfoil 42 formed within the channels 28. The first convex airfoil 40 and the second convex airfoil 42 are symmetrically formed on opposite sides, and inside, of each channel 28, and, as with the channels 28, extend substantially parallel to the longitudinal axis 26 of the tubular member 22.

Figure 7:
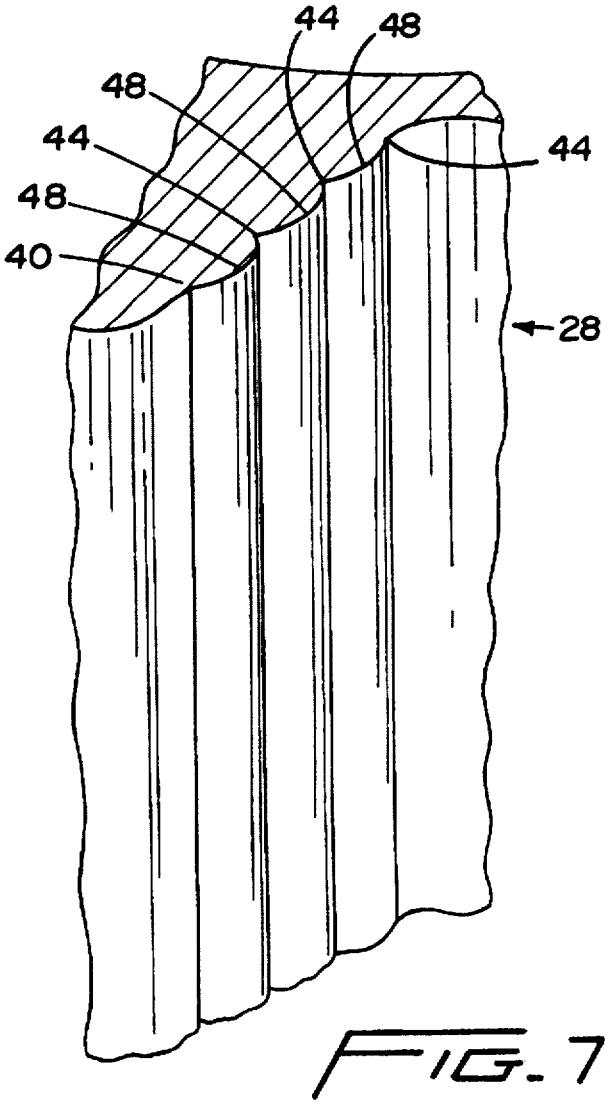
FIG. 7 is a detailed perspective view of the present golf club shaft along the line VII—VII in FIG. 6.

Air resistance is further reduced by providing dimples 44 at the first and second convex airfoils 40, 42 within each of the plurality of the channels 28. Specifically, a plurality of longitudinally extending scales 48 are formed within each of the plurality of channels 28. In fact, the scales 48 are preferably formed on the trailing edges 46 of the first and second convex airfoils 40, 42. As shown in FIGS. 6 and 7, three scales 48 are formed on the trailing edges 46 of each of the convex airfoils 40, 42, thereby creating three longitudinally extending dimples 44. Although the preferred embodiment is provided with scales formed within each of the channels, dimples may be formed in a variety of manners without departing from the spirit of the present invention. In addition to improving the aerodynamic characteristics of the golf club shaft 12, the scales 48 act as reinforcing walls to improve the strength and stiffness characteristics of the golf club shaft 12.

While the preferred embodiment has been shown and described, it will be understood that there is no intent to limit the invention by such disclosure, but rather, is intended to cover all modifications and alternate constructions falling within the spirit and scope of the invention as defined in the appended claims.

I claim:

1. A golf club shaft, comprising:

an elongated tubular member having an outer surface and a longitudinal axis, the elongated tubular member having a plurality of channels formed about the outer surface of the elongated tubular member, wherein each of the plurality of channels includes a plurality of dimples formed therein and the plurality of channels are shaped and dimensioned to create air flow about the elongated tubular member reducing air resistance as the golf club shaft is swung by an individual.

2. The golf club shaft according to claim 1, wherein the elongated tubular member includes a proximal end and a distal end, and the plurality of channels are deeper adjacent the distal end of the elongated tubular member to selectively control the bending point of the golf club shaft and reduce air resistance to a greater degree adjacent the distal end of the elongated tubular member.

3. The golf club shaft according to claim 2, wherein each of the plurality of channels is approximately a maximum of 0.090 inches deep adjacent the distal end of the elongated tubular member and each of the plurality of channels is approximately a maximum of 0.010 inches deep adjacent the proximal end of the elongated tubular member.

4. The golf club shaft according to claim 3, wherein each of the plurality of channels is approximately 0.079 inches deep adjacent the distal end of the elongated tubular member and each of the plurality of channels is approximately 0.004 inches deep adjacent the proximal end of the elongated tubular member.

5. The golf club shaft according to claim 2, wherein each of the plurality of channels is approximately a maximum of 0.090 inches deep adjacent the distal end of the elongated tubular member.

6. The golf club shaft according to claim 2, wherein each of the plurality of channels is approximately a maximum of 0.010 inches deep adjacent the proximal end of the elongated tubular member.

7. The golf club shaft according to claim 1, wherein the elongated tubular member includes a proximal end and a distal end, and the plurality of channels have a greater angle of attack adjacent the distal end of the elongated tubular member to selectively control the bending point of the golf club shaft and reduce air resistance to a greater degree adjacent the distal end of the elongated tubular member.

8. The golf club shaft according to claim 7, wherein each of the plurality of channels is approximately a maximum of 0.090 inches deep adjacent the distal end of the elongated tubular member and each of the plurality of channels is approximately a maximum of 0.010 inches deep adjacent the proximal end of the elongated tubular member.

9. The golf club shaft according to claim 8, wherein each of the plurality of channels is approximately a minimum of 0.050 inches wide adjacent the distal end of the elongated tubular member and each of the plurality of channels is approximately a minimum of 0.10 inches wide adjacent the proximal end of the elongated tubular member.

10. The golf club shaft according to claim 7, wherein each of the plurality of channels is approximately a maximum of 0.090 inches deep adjacent the distal end of the elongated tubular member.

11. The golf club shaft according to claim 7, wherein each of the plurality of channels is approximately a maximum of 0.010 inches deep adjacent the proximal end of the elongated tubular member.

12. The golf club shaft according to claim 7, wherein each of the plurality of channels is approximately a minimum of 0.050 inches wide adjacent the distal end of the elongated tubular member and each of the plurality of channels is approximately a minimum of 0.10 inches wide adjacent the proximal end of the elongated tubular member.

13. The golf club shaft according to claim 1, wherein the dimples are grooves extending substantially parallel to the longitudinal axis of the elongated tubular member.

14. The golf club shaft according to claim 1, wherein the dimples are scales formed within each of the plurality of channels.

15. The golf club shaft according to claim 1, wherein each of the plurality of channels has an outer concave surface, and a first convex airfoil and a second convex airfoil are symmetrically formed within each of the plurality of channels.

16. The golf club shaft according to claim 15, wherein the dimples are grooves extending substantially parallel to the longitudinal axis of the elongated tubular member.

17. The golf club shaft according to claim 15, wherein the dimples are scales formed within each of the plurality of channels.

18. The golf club shaft according to claim 1, including nine channels.

19. A golf club shaft, comprising:

an elongated tubular member having an outer surface, an inner surface and a longitudinal axis, wherein the inner surface has a substantially circular cross-section; and a plurality of channels formed about the outer surface of the elongated tubular member, the plurality of channels being shaped and dimensioned to create air flow about the elongated tubular member reducing air resistance as the golf club shaft is swung by an individual; and the elongated tubular member includes a proximal end and a distal end, and the plurality of channels have a greater angle of attack adjacent the distal end of the elongated tubular member to selectively control the bending point of the golf club shaft and reduce air resistance to a greater degree adjacent the distal end of the elongated tubular member.

20. The golf club shaft according to claim 19, wherein the plurality of channels are deeper adjacent the distal end of the elongated tubular member to selectively control the bending point of the golf club shaft and reduce air resistance to a greater degree adjacent the distal end of the elongated tubular member.

21. The golf club shaft according to claim 19, wherein the plurality of channels extend substantially parallel to the longitudinal axis of the tubular member.

* * * * *

UNITED STATES PATENT AND TRADEMARK OFFICE

CERTIFICATE OF CORRECTION

PATENT NO : 5,795,244

DATED : August 18, 1998

INVENTOR(S): Clive S. Lu

It is certified that error appears in the above-identified patent and that said Letters Patent is hereby corrected as shown below:

On the title page, item [76], please correct the Inventor's name as follows: please delete "Clife" and insert in its place --Clive--.

Signed and Sealed this

Fifteenth Day of December, 1998

Bruce Lehman

*Attest:*

BRUCE LEHMAN

*Attesting Officer*

*Commissioner of Patents and Trademarks*